United States Patent [19]

Davis

[11] 4,446,575

[45] May 8, 1984

[54] HOSPITAL SHORTS

[76] Inventor: Glenn R. Davis, 1213 Randy, Irving, Tex. 75060

[21] Appl. No.: 306,488

[22] Filed: Sep. 28, 1981

[51] Int. Cl.[3] ..... A41B 9/00

[52] U.S. Cl. ..... 2/400; 2/408; 2/DIG. 7

[58] Field of Search ..... 2/238, 114, DIG. 7, 2/DIG. 6, 400, 406, 237, 408

[56] References Cited

U.S. PATENT DOCUMENTS

| | | | |
|---|---|---|---|
| 602,188 | 4/1898 | Sittig | 2/238 |
| 888,232 | 5/1908 | Galland | 2/408 |
| 3,154,082 | 10/1964 | Cape | 2/408 X |
| 3,208,454 | 9/1965 | Farkas | 2/408 X |
| 3,251,360 | 5/1966 | Melges | 2/DIG. 7 |
| 4,280,230 | 7/1981 | La Fleur | 2/408 |

FOREIGN PATENT DOCUMENTS

| | | | |
|---|---|---|---|
| 208956 | 4/1909 | Fed. Rep. of Germany | 2/408 |

*Primary Examiner*—H. Hampton Hunter

*Attorney, Agent, or Firm*—Jerry W. Mills; Gregory M. Howison; Nina Medlock

[57] ABSTRACT

Shorts adapted for use by patients in hospitals, clinics and physicians' offices. A pair of shorts are provided having a front portion (12) and rear portion (14) joined together at a crotch (20) and including a waistband (16) and identical leg portions (18) extending from the crotch substantially above the patient's knees. The rear portion contains an elongated opening (22) extending from below the waistband to above the crotch. A flap (24) secured at its lower end to the rear portion just below the opening contains a fastener (30) at the opposite end of the flap adapted to be removably fastened to a fastener (32) disposed on the rear portion above the opening whereby the flap covers the opening and can be unfastened to provide access to the patient's anal area.

3 Claims, 4 Drawing Figures

HOSPITAL SHORTS

TECHNICAL FIELD

The present invention relates generally to garments and more particularly to special garments for use in hospitals, clinics and physicians' offices.

BACKGROUND ART

In the treatment and examinations of gastrointestinal complaints, patients are often required to undergo proctoscopy, sigmoidoscopy, colonescopy and barium enemas. These examinations are sometimes lengthy and typically require disrobing, which causes the patient to become chilled and which causes embarrassment.

Hospital gowns or hospital pajamas presently worn by patients for these examinations are unsatisfactory because they lead to expressive exposure of the patient's body and causing discomfort and unnecessary embarrassment.

Accordingly, a need arises for a garment which can be worn by the patient during the proctoscopic examination and treatment, which prevents the patient from becoming chilled and protects his or her privacy, but does not interfere with treatment and examination.

SUMMARY OF THE INVENTION

The present invention is designed to provide comfort for the patient undergoing proctological examination and treatment. A pair of shorts adapted for use by patients in hospitals, clinics and physicians' offices is provided. The trunks have front and rear portions joined together at a crotch. The trunks define a waistband and include a pair of identical leg portions extending below the crotch a distance well above the patient's knee. The rear portion defines an elongated opening extending centrally thereof from below the waistband to above the crotch. A flap dimension to cover the opening is secured at its lower end to the rear portion below the opening. The flap contains a fastener at the opposite end thereof for fastening the upper end to the rear portion of the trunks to cover the opening with the flap. The shorts are dimensioned to provide excessive gather to provide access to the patient's body through the opening when the flap is unsecured.

BRIEF DESCRIPTION OF DRAWINGS

A more complete understanding of the invention can be had by reference to the following Detailed Description in conjunction with the accompanying Drawings, in which.

DETAILED DESCRIPTION

Figure 1:
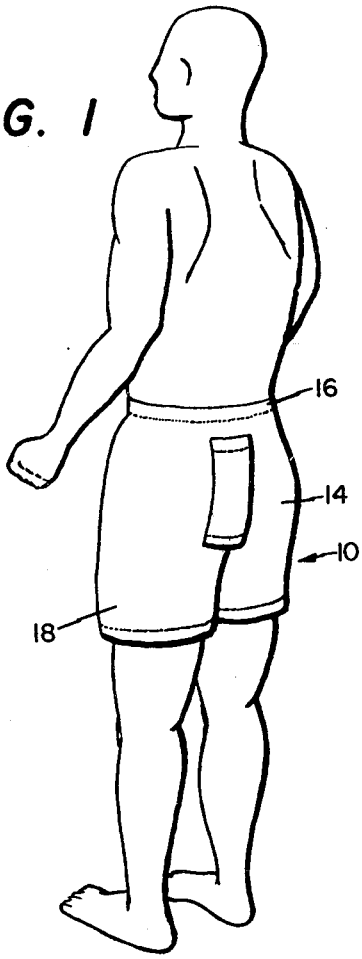
FIG. 1 is a rear view of the present invention as worn by a patient.

Referring now to the Drawings, in which like reference numerals designate like or corresponding elements throughout the views, the present invention is shown in FIG. 1, as worn by a patient.

The present invention 10 comprises a pair of loose shorts or trunks 10 having a front portion 12 (FIG. 4), a rear portion 14, a waistband 16 and leg portions 18 extending from a crotch 20. Leg portions 18 are relatively short, as shown in FIG. 1, and extend well above the patient's knee, as in conventional trunks or shorts.

Trunks 10 are designed to fit loosely about the waist and to provide substantial gather below the patient's waist such that access to the patient's body is provided without interference of the garment. The trunks may be made of inexpensive cloth or paper so as to be disposable after use by the patient.

Figure 2:
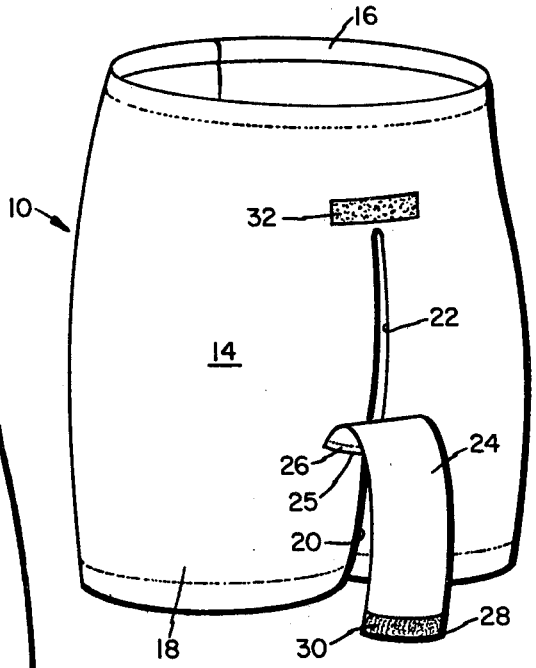
FIG. 2 is a detailed rear view of the present invention of FIG. 1 illustrating the opening, the flap and fastener.

As best seen in FIG. 2, an elongated opening 22 extends centrally down the rear portion 14 of the trunks from a point below the waistband to a point just above the crotch 20. Opening 22 is typically about 5 to 8 inches in length and can be spread to a width of about 6 inches. When uncovered, opening 22 provides access to the patient's anal region.

Figure 3:
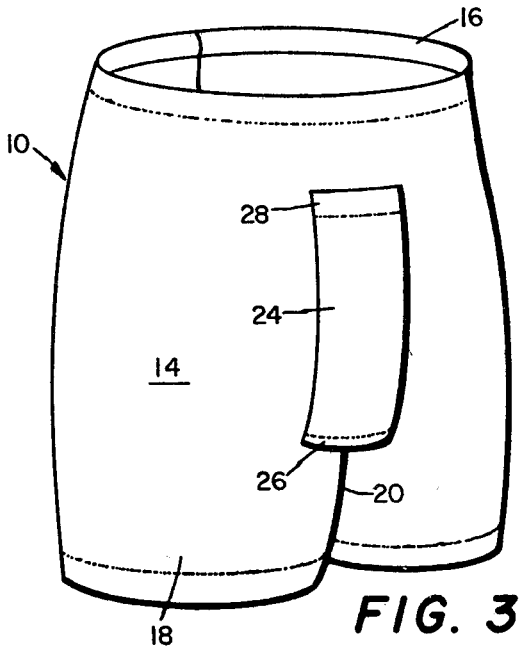
FIG. 3 is a detailed rear view of the present invention of FIGS. 1 and 2 illustrating the rear flap covering the opening.

In the preferred embodiment, a rectangular flap 24, slightly longer than the opening 22 and having a width of 3 to 4 inches, is provided for covering opening 22 when the patient is not being treated. Flap 24 is joined at its lower end 25 to rear portion 14 at seam 26 (FIGS. 2 and 3), just above the crotch 20. The opposite end 28 contains a VELCRO strip 30 or other type of fastener (FIG. 2) on the inside of flap 24 which is adapted to be removably fastened to a corresponding VELCRO strip 32 or fastener disposed on the outside of rear portion 14, just above opening 22, as shown in FIGS. 2 and 3. When flap 24 is fastened to fastener 32, the opening 22 is covered as in FIG. 3. When the physician administers treatment or conducts a proctoscopy or sigmoidoscopy, the patient can be ushered into a private examination area, be placed in proper position and the physician can remove flap 24 by unfastening the fasteners and exposing the patient's anal area for examination or treatment. The present invention permits the patient to wear a shirt or top with the trunks and therefore, complete disrobing and removal of a hospital gown is not required. Thus, while awaiting treatment, and during treatment, the patient is exposed to a minimum of cold and embarrassment.

Figure 4:
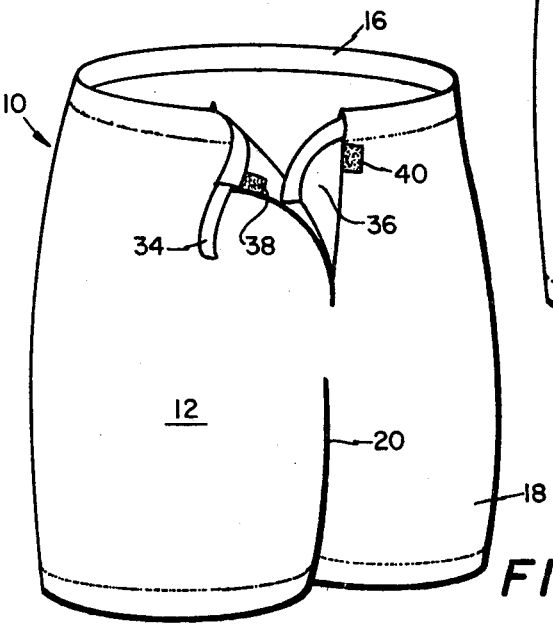
FIG. 4 is a detailed front view of the present invention shown in FIGS. 1–3 illustrating the waistband and tie strings.

An important aspect of the present invention is the substantial gather provided below the waist which permits the physician to administer treatment without interference from the garment. The trunks, which are relatively baggy compared to those that would normally be worn by the patient, are provided with an adjustable waistband 16. FIG. 4 illustrates the front portion of the garment in which the waistband 16 is provided with drawstring or drawstrings 34. An opening 36 is also provided at the front of the waistband, as shown in FIG. 4, extending down the front portion 12 and terminating above the crotch. Fasteners 38 and 40 are provided near the top of the opening 36, as shown in FIG. 4, to fasten the shorts about the patients' waist. Fastener 38 is disposed on the inside of the shorts adjacent one side of opening 36, while fastener 40 is disposed on the outside of the shorts on the opposite side of the opening. Drawstrings 34 and fasteners 38 and 40 permit a single size of shorts to fit a wide variety of patients and provide a proper fit at the waist while providing substantial gather below the waist.

Thus, the present invention provides a garment which the patient can wear in hospitals and examination rooms which insulates the patient from cold and embarrassment, yet which provides access to the patient's body with a minimum of interference from the garment.

From the foregoing, it will be apparent the present invention comprises a significant advance over the hospital garments now used in hospitals and clinics.

Although particular embodiments of the invention have been illustrated in the accompanying Drawings and described in the foregoing Detailed Description, it will be understood that the invention is not limited to embodiments disclosed, but is intended to embrace any alternatives, modifications and rearrangements and/or substitutions of elements falling within the scope of the invention as defined by the following claims.

I claim:

1. Shorts adapted for use by patients undergoing proctological examination and treatment to protect the patient's privacy without interfering with examination or treatment, comprising:

a pair of trunks having front and rear portions joined together at a crotch and including a waistband and having identical leg portions extending from said front and back portions below said crotch a distance substantially above the patient's knee;

said rear portion having an elongated opening centrally thereof extending from a point spaced below said waistband to a point rearwardly of and spaced above said crotch to provide access through said opening to the patient's anal region for examination or treatment;

said front and rear portions further being dimensioned to gather below said waistband so that access through said opening is not interfered with by said shorts;

said waistband being open at the front central portion thereof and including a drawstring for adjusting the fit at the patient's waist and including fasteners at said front central portion for fastening said waistband; and a rectangular flap having an upper and lower end, dimensioned to cover said opening in said rear portion, said flap being permanently secured at its lower end to said rear portion below said opening above said crotch and having fastening means at the opposite end thereof for removably fastening said upper end portion to said rear portion above said opening for covering said opening with said flap.

2. The invention of claim 1 wherein said shorts are made of paper.

3. The invention of claim 1 wherein said shorts are made of cloth.

* * * * *